US010139183B1

(12) United States Patent
Liu

(10) Patent No.: US 10,139,183 B1
(45) Date of Patent: Nov. 27, 2018

(54) BIPOD

(71) Applicant: Cheh-Kang Liu, Taipei (TW)

(72) Inventor: Cheh-Kang Liu, Taipei (TW)

( * ) Notice: Subject to any disclaimer, the term of this patent is extended or adjusted under 35 U.S.C. 154(b) by 0 days.

(21) Appl. No.: 15/880,614

(22) Filed: Jan. 26, 2018

(51) Int. Cl.
*F41A 23/10* (2006.01)

(52) U.S. Cl.
CPC ..... *F41A 23/10* (2013.01)

(58) Field of Classification Search
CPC ..... F41A 23/06; F41A 23/10; F41A 23/14
See application file for complete search history.

(56) References Cited

U.S. PATENT DOCUMENTS 5,593,239 A * 1/1997 Sallee ..... E04H 12/182 135/114
7,434,773 B1 * 10/2008 Minjares ..... F41A 23/06 124/86
8,402,684 B1 * 3/2013 Beltz ..... F41A 23/10 42/72

FOREIGN PATENT DOCUMENTS

GB 2346202 A * 8/2000 ..... F41A 23/06

* cited by examiner

*Primary Examiner* — Joshua T Semick
(74) *Attorney, Agent, or Firm* — Jackson IPG PLLC; Demian K. Jackson

(57) ABSTRACT

A bipod consisting of a support frame unit, left and right outer tubes, left and right inner tubes, left and right guide blocks, left and right links, left and right pressure handle holders, left and right ball bearings and left and right torsion springs is disclosed for easy carrying with an attached gun to enhance application flexibility and mobility. The user can use one hand to bias the left/right pressure handle with the left/right inner tube through 360-degrees to any desired angle and then downwardly adjust the elevation of the left/right inner tube relative to the left/right outer tube, or press the left/right pressure handle with one hand. When released the hand from the left/right pressure handle, the balls in the left/right ball bearing are engaged between the top cone of the left/right guide block and the inside wall of the left/right outer tube.

10 Claims, 17 Drawing Sheets

BIPOD

BACKGROUND AND SUMMARY OF THE INVENTION

The present invention relates to hunting gear and more specifically, to a bipod for the fixation of a gun, which facilitates carrying, allows adjustment of angle and height with one hand and ensures positioning stability after adjustment.

Conventional bipods cannot be easily carried with a gun during hunting or training practice because they cannot be fixed with the gun. Further, some conventional bipods need to use both hands to achieve height adjustment and adjustment procedure is quite troublesome. Although some conventional bipods allow adjustment with one single hand, but they are limited to a fixed spacing of height position adjustment. After adjustment, the structure may be loosened, and the adjusted positioning stability is still poor.

Although some conventional bipods allow fixation of a gun, but still need two-handed operation to achieve elevation adjustment. This two-handed adjustment procedure is very inconvenient.

The present invention has been accomplished under the circumstances in view. It is therefore the main object of the present invention to provide a bipod, which allows fixation of a gun so that the gun can be conveniently carried with the bipod to a predetermined place, enhancing flexibility and mobility.

According to another aspect of the present invention, the user can use one hand to bias the left/right pressure handle with the left/right inner tube through 360-degrees to any desired angle and then downwardly adjust the elevation of the left/right inner tube relative to the left/right outer tube, or press the left/right pressure handle with one hand to upwardly adjust the elevation of the left/right inner tubes relative to the left/right outer tubes in a stepless manner. When released the hand from the left/right pressure handle, the balls in the left/right ball bearing are engaged between the top cone of the left/right guide block and the inside wall of the left/right outer tube to lock the left/right inner tube to the left/right outer tube.

DETAILED DESCRIPTION OF THE INVENTION

Figure 1:
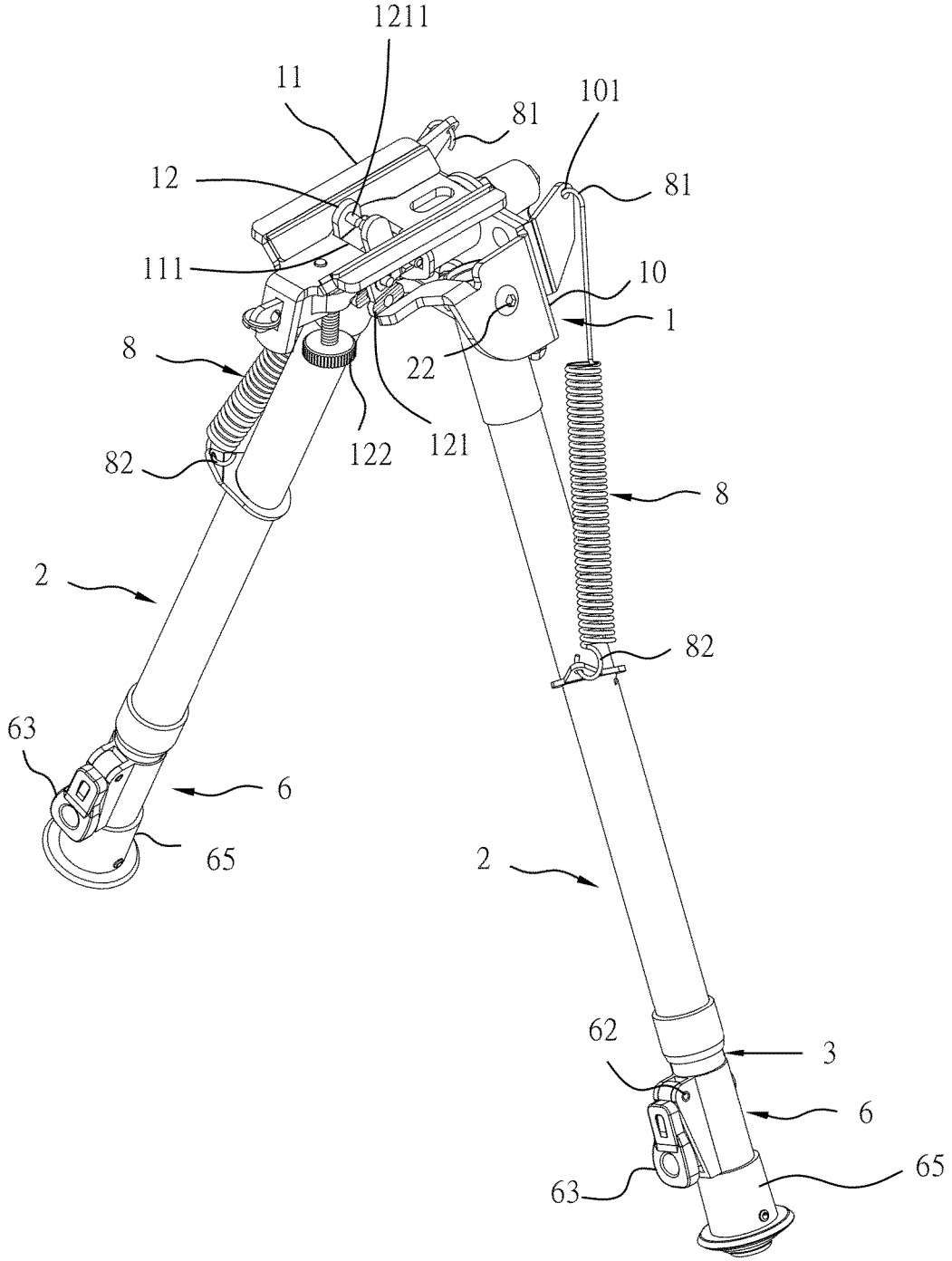
FIG. 1 is an extended view of a bipod in accordance with the present invention.
Figure 2:
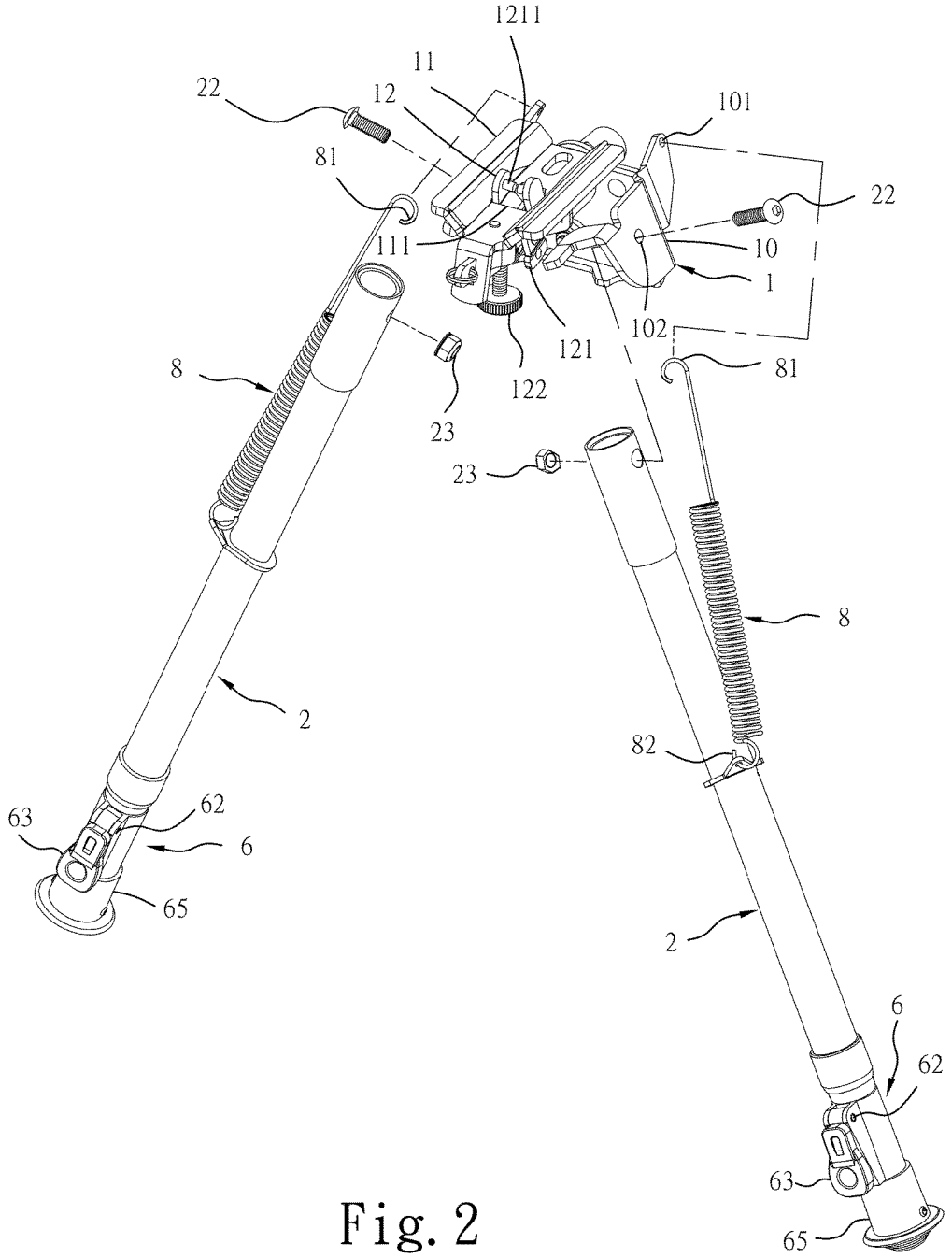
FIG. 2 is an exploded view of the bipod in accordance with the present invention.
Figure 3:
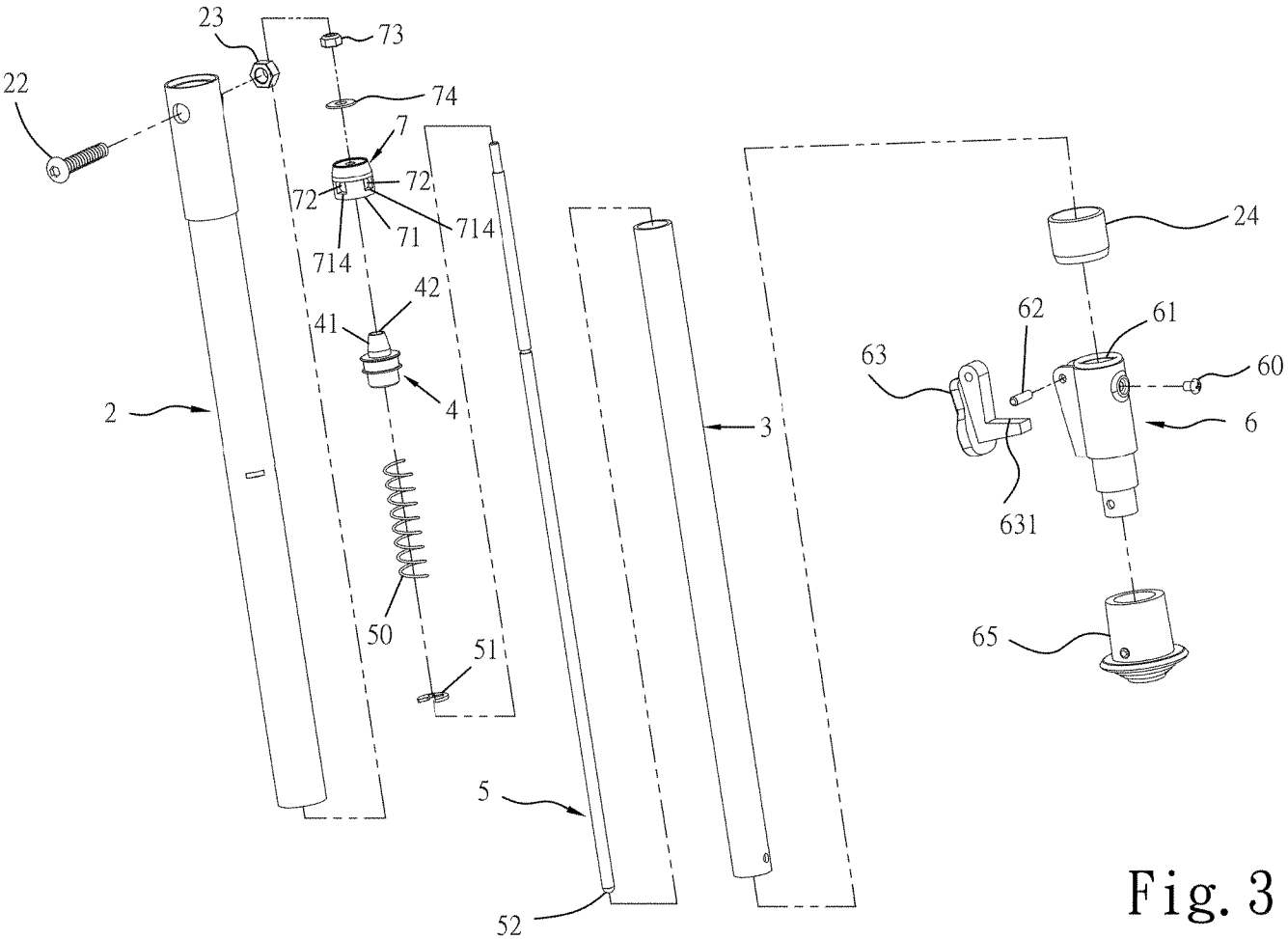
FIG. 3 is an exploded view of a part of the present invention
Figure 4:
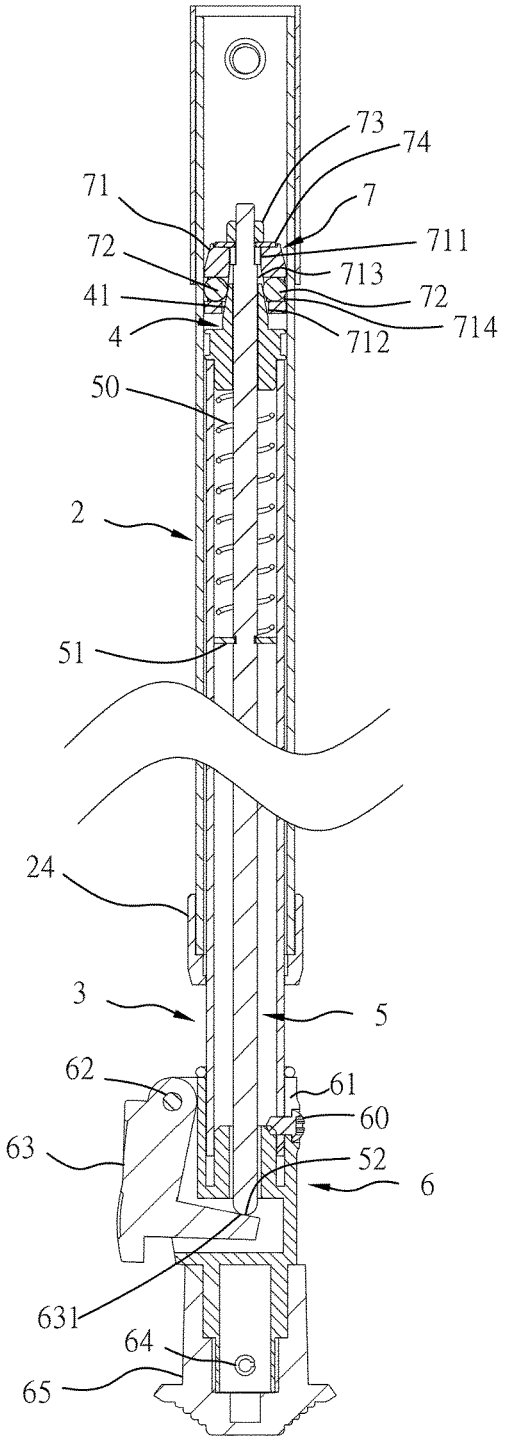
FIG. 4 is a sectional view of a part of the present invention.
Figure 5:
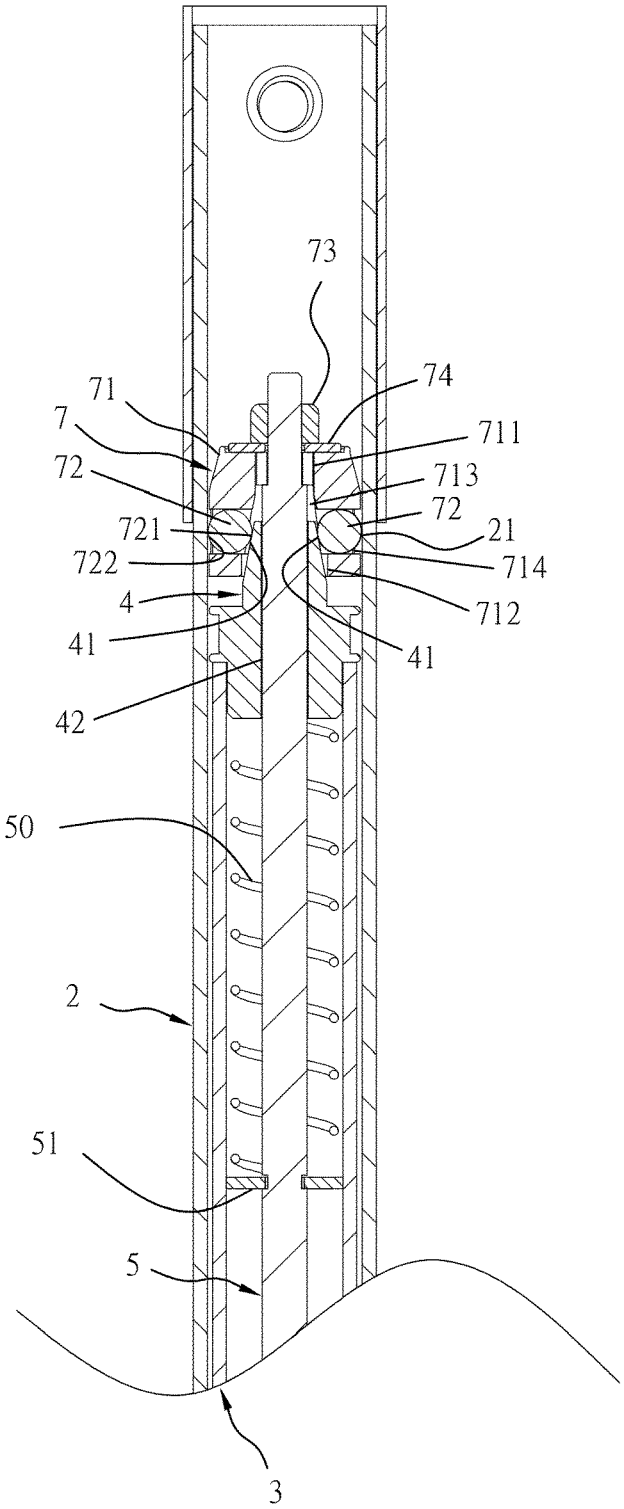
FIG. 5 is an enlarged view of a part of FIG. 4.
Figure 6:
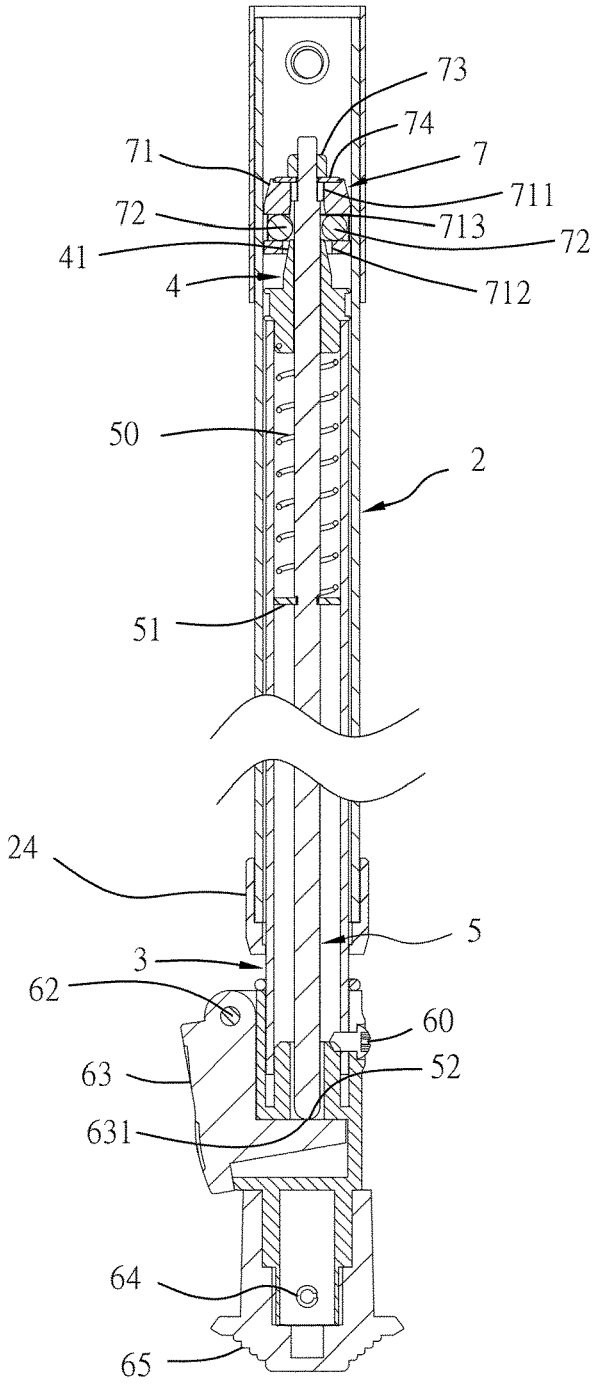
FIG. 6 is an enlarged view of a part of the present invention, illustrating the pressure handle pressed.
Figure 7:
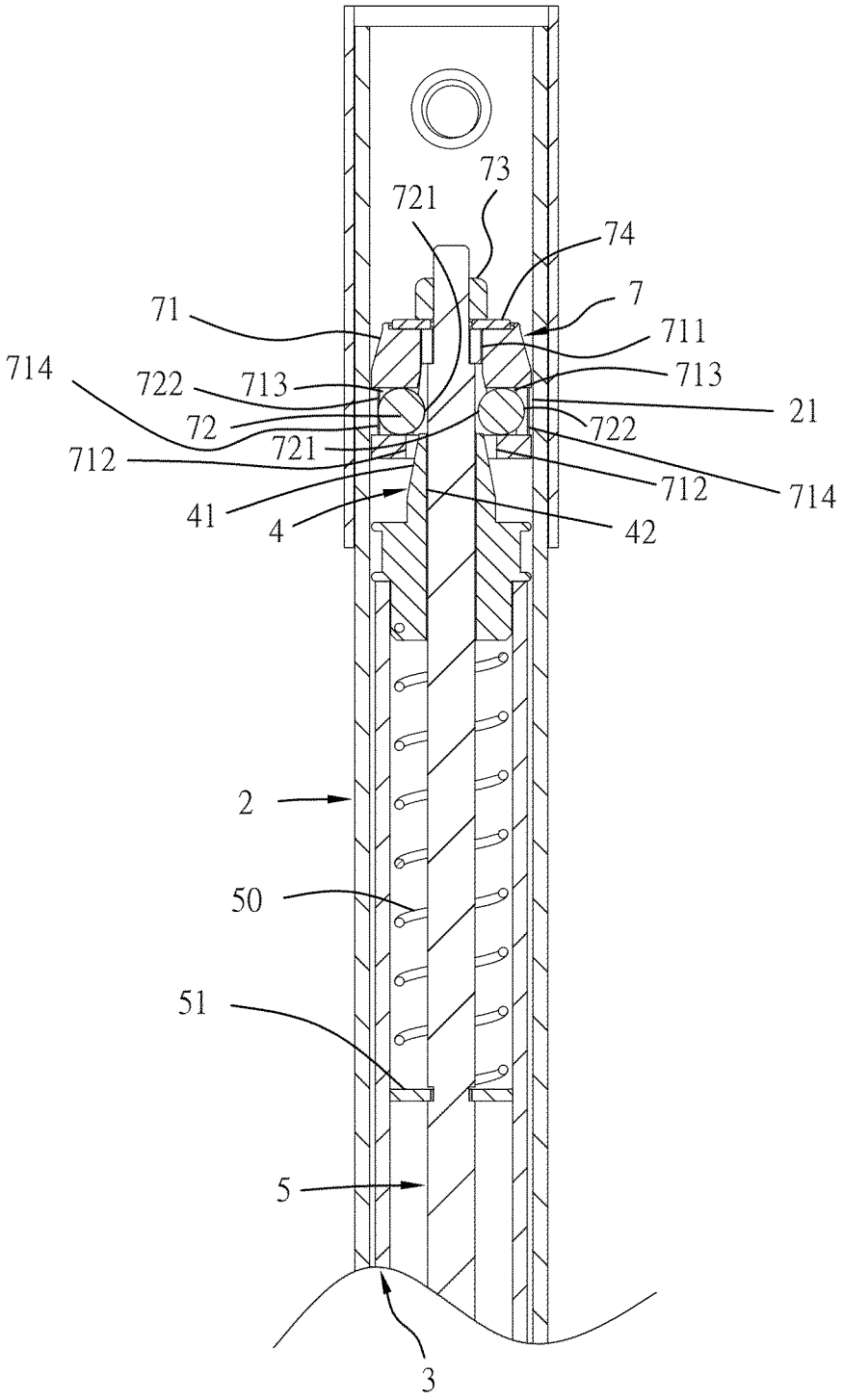
FIG. 7 is an enlarged view of a part of FIG. 6.
Figure 10:
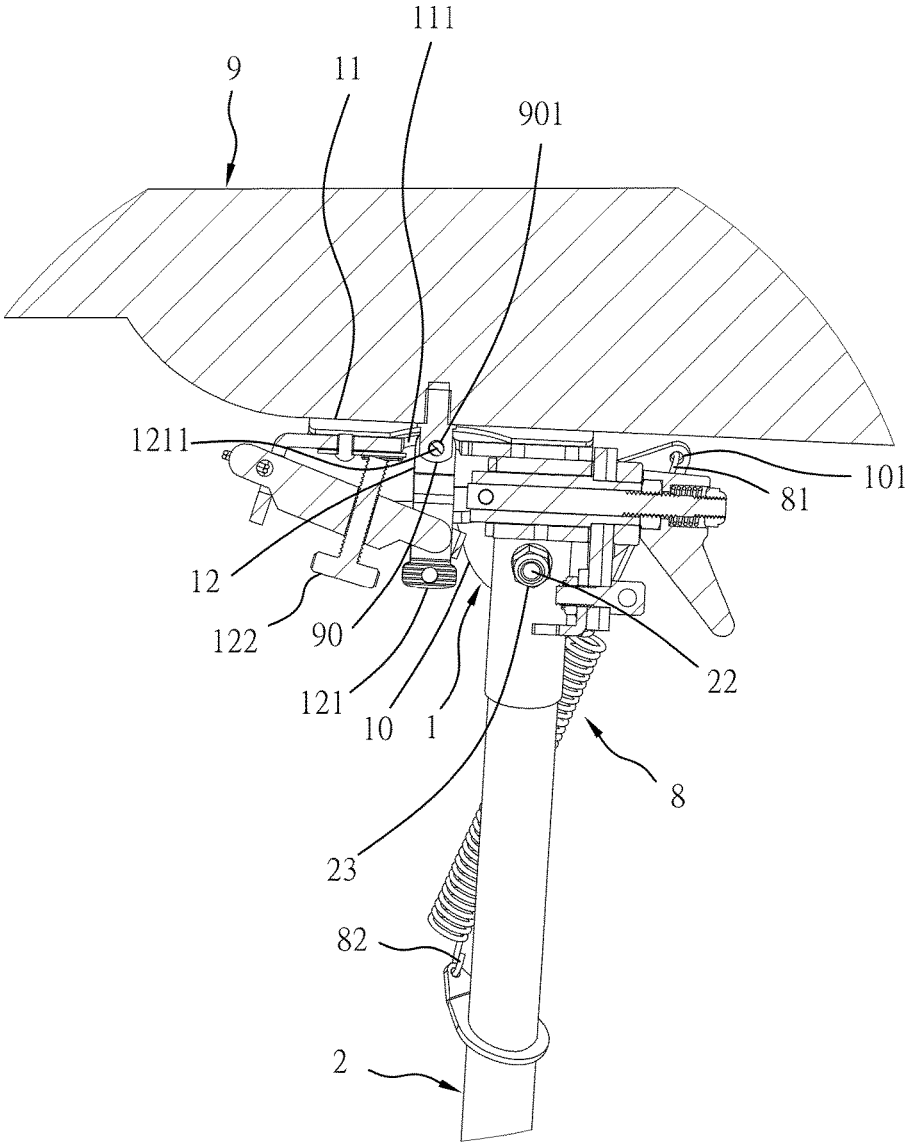
FIG. 10 is a schematic enlarged view of a part of the present invention, illustrating a gun fastened to the mounting assembly.

Referring to FIGS. 1-7, a bipod in accordance with the present invention is shown. The bipod comprises:

a support frame unit 1 comprising a bracket 10 (see FIGS. 1 and 2), a support fitting 11 mounted at a top side of the bracket 10, and a mounting assembly 12 adapted for securing a gun 9 to the support fitting 11 (see FIG. 10);

left and right outer tubes 2 (see FIGS. 1-7) having respective top ends thereof respectively pivotally connected to left and right pivot holes 102 of the bracket 10 of the support frame unit 1 by a respective first pivot bolt and nut set 22,23 (see FIG. 2) and respective bottom ends thereof respectively mounted with a respective end cap 24 (see FIGS. 3, 4 and 6);

left and right inner tubes 3 respectively and axially slidably mounted in the left and right outer tubes 2 and respectively rotatable through 360-degrees angle relative to the left and right outer tubes 2;

left and right guide blocks 4 (see FIGS. 3-7) respectively affixed to respective top ends of the left and right inner tubes 3, each comprising a top cone 41 gradually reducing in diameter from a bottom side toward an opposing top side thereof and an axial through hole 42 axially cut through the opposing top and bottom sides thereof;

left and right links 5 (see FIGS. 3-7) respectively inserted into the left and right inner tubes 3;

left and right stop rings 51 respectively fastened to the left and right links 5 above a middle part thereof (see FIGS. 3-7);

left and right compression springs 50 respectively mounted around the left and right links 5 within the left and right inner tubes 3 and respectively stopped between the left and right stop rings 51 and the left and right guide blocks 4 (see FIGS. 3-7);

left and right pressure handle holders 6 respectively affixed to respective bottom ends of the left and right inner tubes 3 by a respective first fastener 60 (see FIGS. 4 and 6) and respectively defining therein a longitudinal through hole 61 for the insertion of respective bottom ends of the left and right links 5 respectively (see FIGS. 3, 4 and 6);

left and right pressure handles 63 respectively pivotally connected to the left and right pressure handle holders 6 by a respective second pivot member 62 (see FIGS. 3, 4 and 6), each having a guide surface 631 respectively abutted against respective bottom ends 52 of the left and right links 5 (see FIGS. 3, 4 and 6) for lifting the left and right links 5 when the left and right pressure handles 63 are respectively biased by an external force toward the left and right inner tubes 3

(see FIG. 6) and for allowing the left and right links 5 to be respectively forced downwards by the left and right compression springs 50 after the external force is released from the left and right pressure handles 63 (see FIG. 4);

left and right foot members 65 respectively affixed to respective bottom sides of the left and right pressure handle holders 6 by a respective second fastener 64 (see FIGS. 4 and 6);

left and right ball bearings 7 respectively fastened to respective opposing top ends of the left and right links 5 (see FIGS. 3-7, FIG. 17) by respective positioning component sets 73,74 (see FIGS. 3 and 4) for vertical movement with the left and right links 5, each comprising a bearing block 71, which comprises a top axle hole 711 of relatively smaller diameter, an opposing bottom axle hole 712 of relatively larger diameter and an intermediate hole 713 axially connected between the top axle hole 711 and the bottom axle hole 712 and a plurality of balls 72 rotatably and radially movably mounted in the bearing block 71 (see FIGS. 5 and 7) such that when the left and right ball bearings 7 are moved upwards with the left and right links 5 (see FIGS. 6 and 7), respective inner sides 721 of the balls 72 are respectively disengaged from the top cones 41 of the left and right guide blocks 4 (see FIG. 7) for allowing the left and right inner tubes 3 to slide vertically relative to the left and right outer tubes 2; when the left and right ball bearings 7 are moved downwards with the left and right links 5 (see FIGS. 4 and 5), the respective inner sides 721 of the balls 72 are respectively abutted against the top cones 41 of the left and right guide blocks 4 and respective outer sides 722 of the balls 72 are respectively abutted against respective inside walls 21 of the left and right outer tubes 2 (see FIGS. 4 and 5); and left and right torsion springs 8 with respective one ends 81 thereof respectively fastened to left and right locating holes 101 of the bracket 10 of the support frame unit 1 (see FIG. 2) and respective opposite ends 82 thereof respectively fastened to the top ends of the left and right outer tubes 2.

Figure 8:
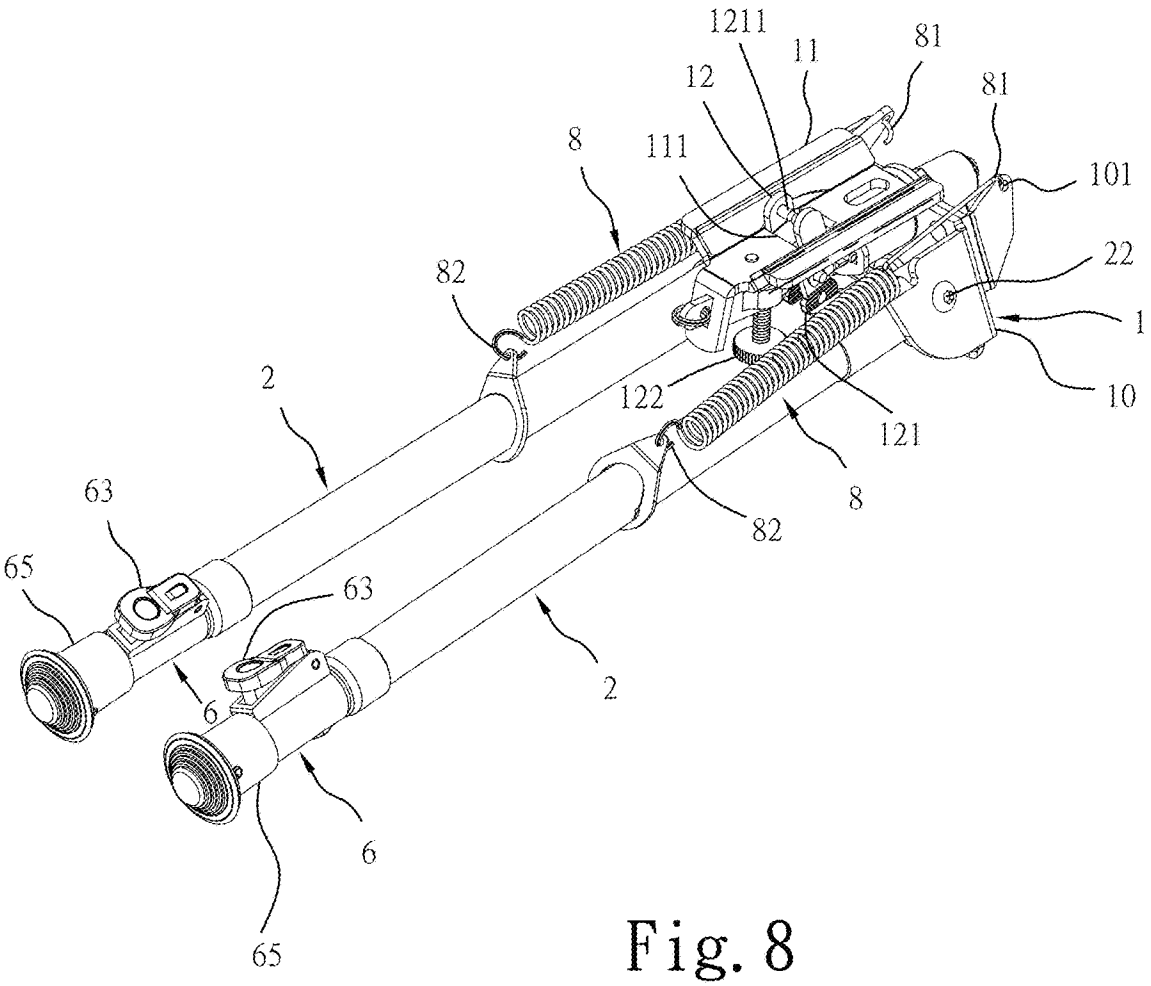
FIG. 8 is a schematic drawing of the present invention, illustrating the bipod collapsed.

Thus, the bipod with the attached gun 9 can be conveniently carried to a predetermined place. When wishing to adjust the elevation of the bipod, bias the left/right pressure handle 63 with the left/right inner tube 3 to the desired angle, and then press the left/right pressure handle 63 with one hand (see FIGS. 6 and 7) to force the guide surface 631 against the left/right link 5 upwardly in compressing the left/right compression spring 50 (see FIGS. 3-7). After moved the left/right link 5 upward, the respective inner sides 721 of the balls 72 of the left/right ball bearing 7 are disengaged from the top cone 41 of the left/right guide block 4 (see FIGS. 6 and 7), causing upward movement of the left/right inner tube 3 relative to the left/right outer tube 2 to the desired height; when the user releases the hand from the left/right pressure handle 63, the elastic restoring energy of the left/right compression spring 50 immediately pushes the left and right link 5 downwards (see FIGS. 4 and 5), forcing the respective inner sides 721 of the balls 72 of the left/right ball bearing 7 into engagement with the top cone 41 of the left/right guide block 4 and the respective outer sides 722 of the balls 72 into engagement with the inside wall 21 of the left/right outer tube 2, thereby locking the left/right inner tube 3 to the left/right outer tube 2; further, when the user wishes to adjust the elevation of the left/right inner tube 3 downwardly relative to the left/right outer tube 2, the adjustment can be achieved conveniently with one hand by directly pushing the left/right inner tube 3 downwardly to the desired elevation without needing to bias the left/right pressure handle 63. When the user pushes the left/right inner tube 3 downwardly to the desired elevation, the top cone 41 of the left/right guide block 4 is moved with the left and right inner tube 3 away from the inner sides 721 of the balls 72 of the left/right ball bearing 7 to unlock the left/right inner tube 3 from the left/right outer tube 2. Further, when collapsing the bipod, bias the left and right outer tubes 2 toward the support frame unit 1 to reduce the overall dimension, and thus, the bipod is collapsed as shown in FIG. 8.

Further, each bearing block 71 of the left and right ball bearings 7 comprises a plurality of transverse through holes 714 equiangularly spaced around the periphery and respectively disposed in communication with the associating intermediate hole 713 (see FIGS. 3-5, 7 and 17) for allowing the respective outer sides 722 of the balls 72 to pass therethrough into engagement with the inside wall 21 of the left and right outer tubes 2.

Figure 9:
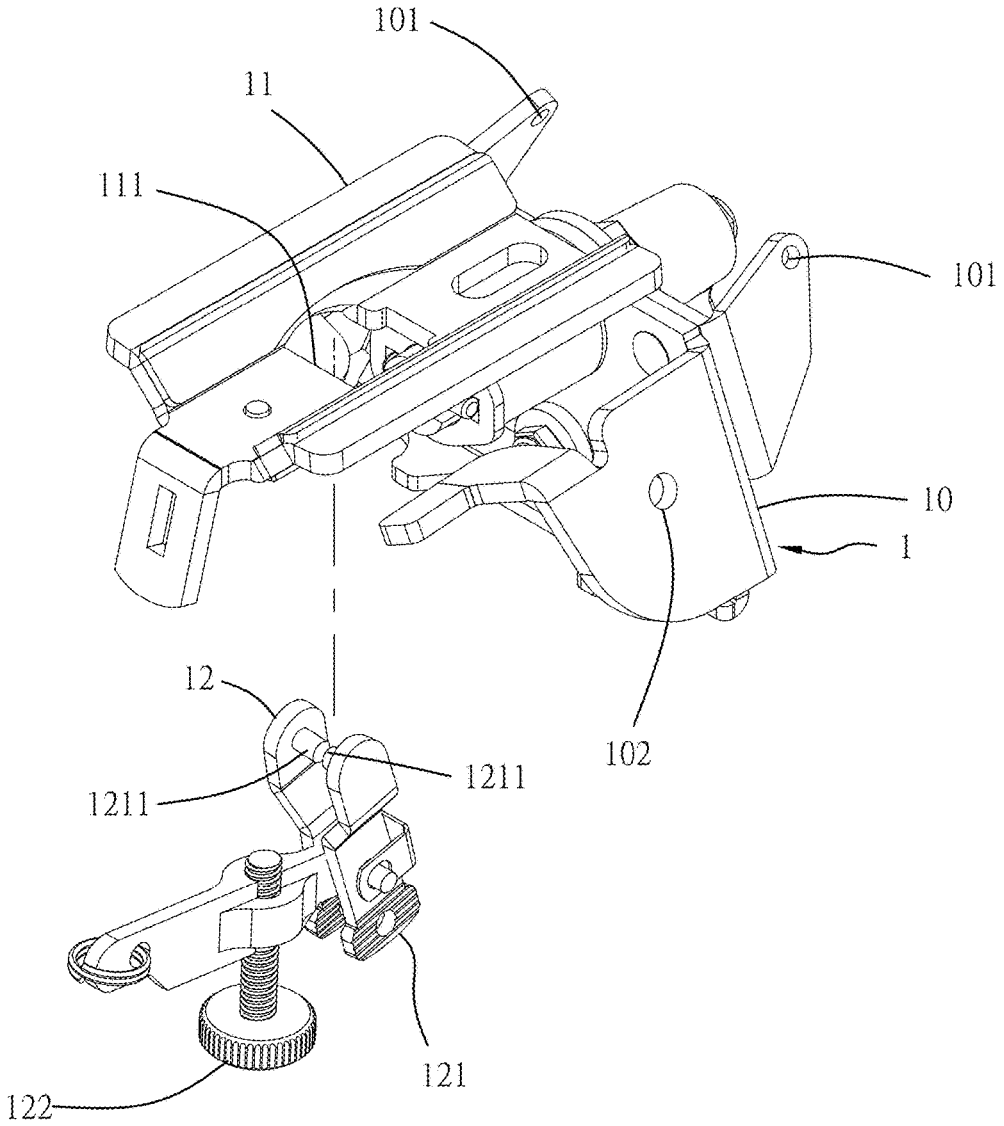
FIG. 9 is an exploded view in an enlarged scale of the support fitting and mounting assembly of the support frame unit.

Referring to FIG. 9, the support fitting 11 of the support frame unit 1 comprises a locating hole 111; the mounting assembly 12 comprises a grip clip 121 and a first lock screw 122. The grip clip 121 comprises two clamping pins 1211. In installation, the grip clip 121 is inserted into the locating hole 111 of the support fitting 11 and the two clamping pins 1211 of the grip clip 121 are engaged into a gun strap hole 901 of a swivel stud 90 of the gun 9 (see FIG. 10), and then the first lock screw 122 is fastened tight to lock the support fitting 11 to the gun 9.

Figure 11:
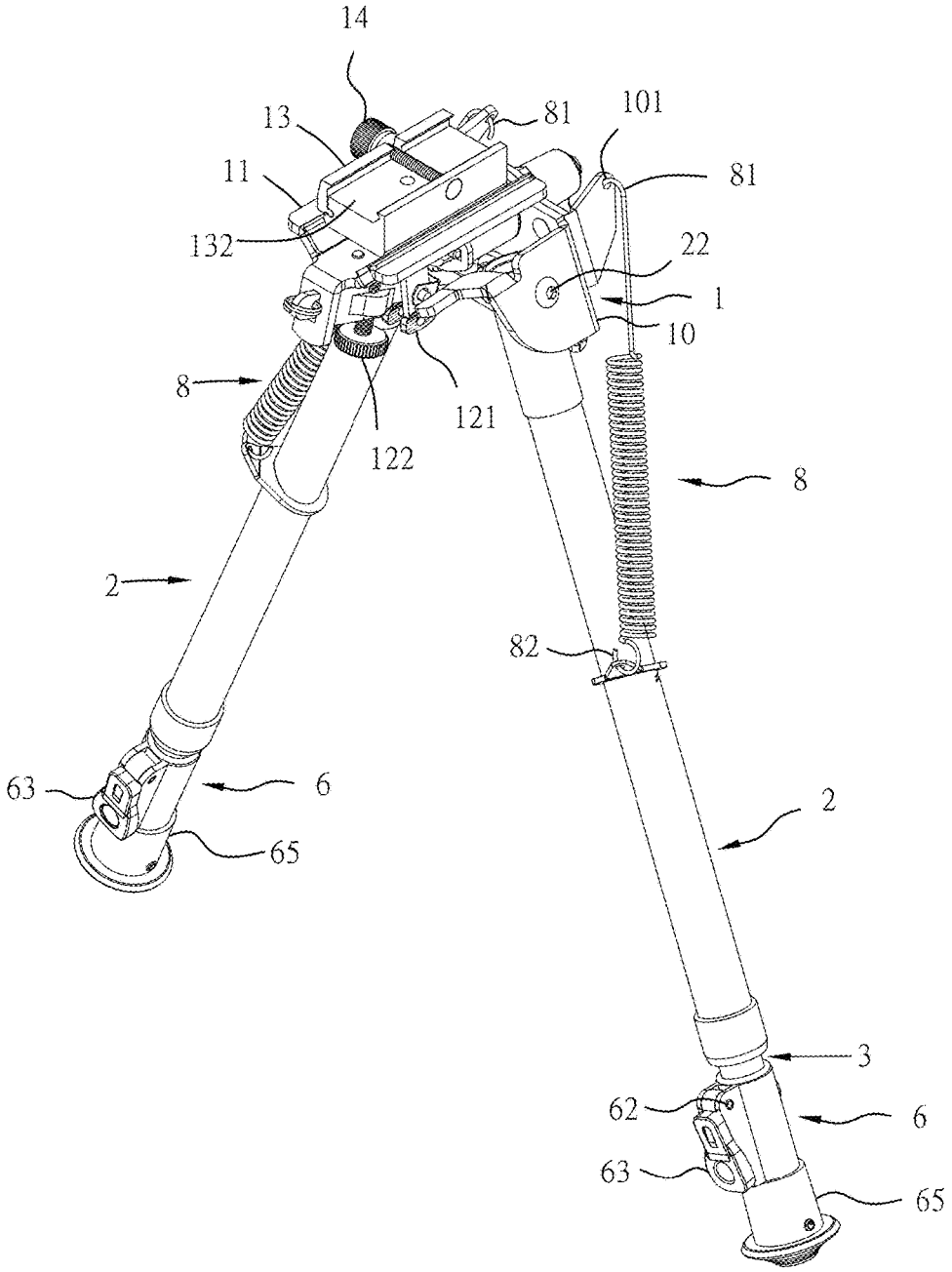
FIG. 11 in an elevational view of an alternate form of the present invention, illustrating a holder block and a second lock screw mounted in the mounting assembly of the support frame unit.
Figure 12:
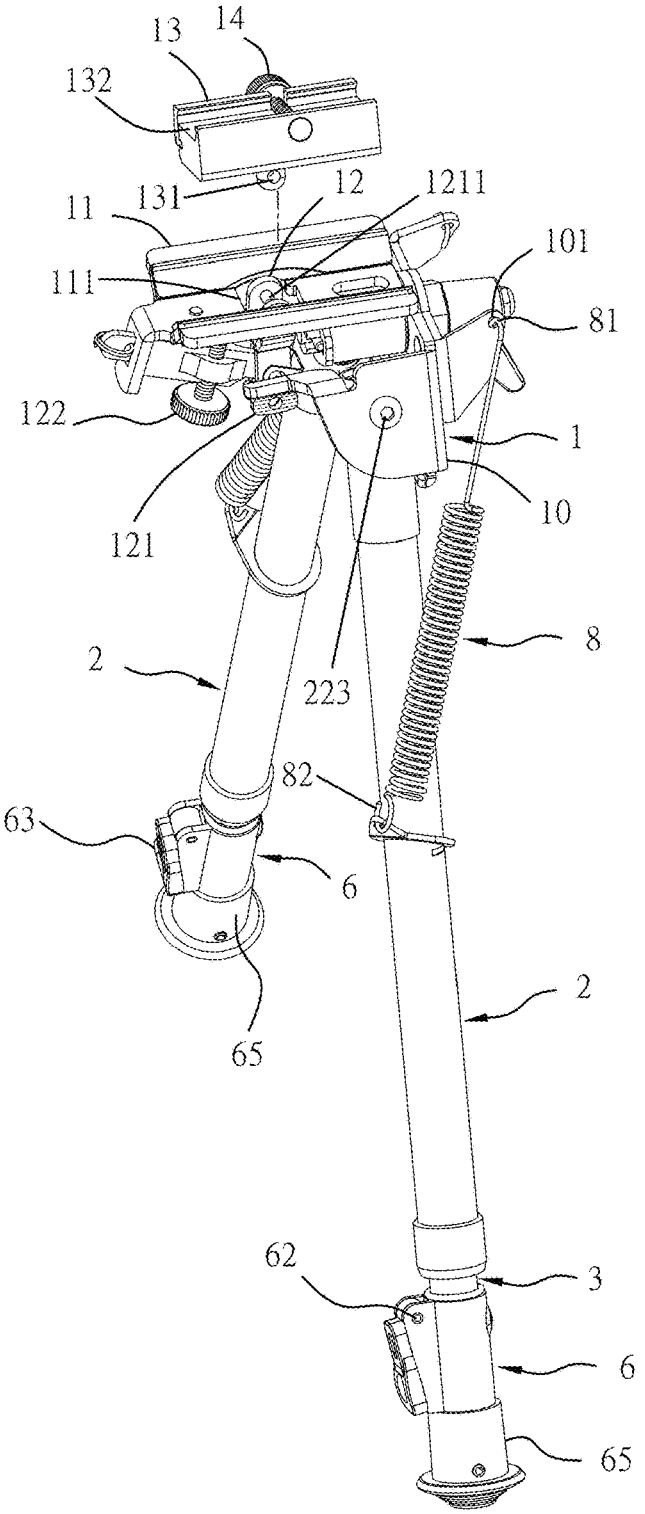
FIG. 12 is an exploded view of the holder block and second lock screw of the mounting assembly of the support frame unit shown in FIG. 11.
Figure 13:
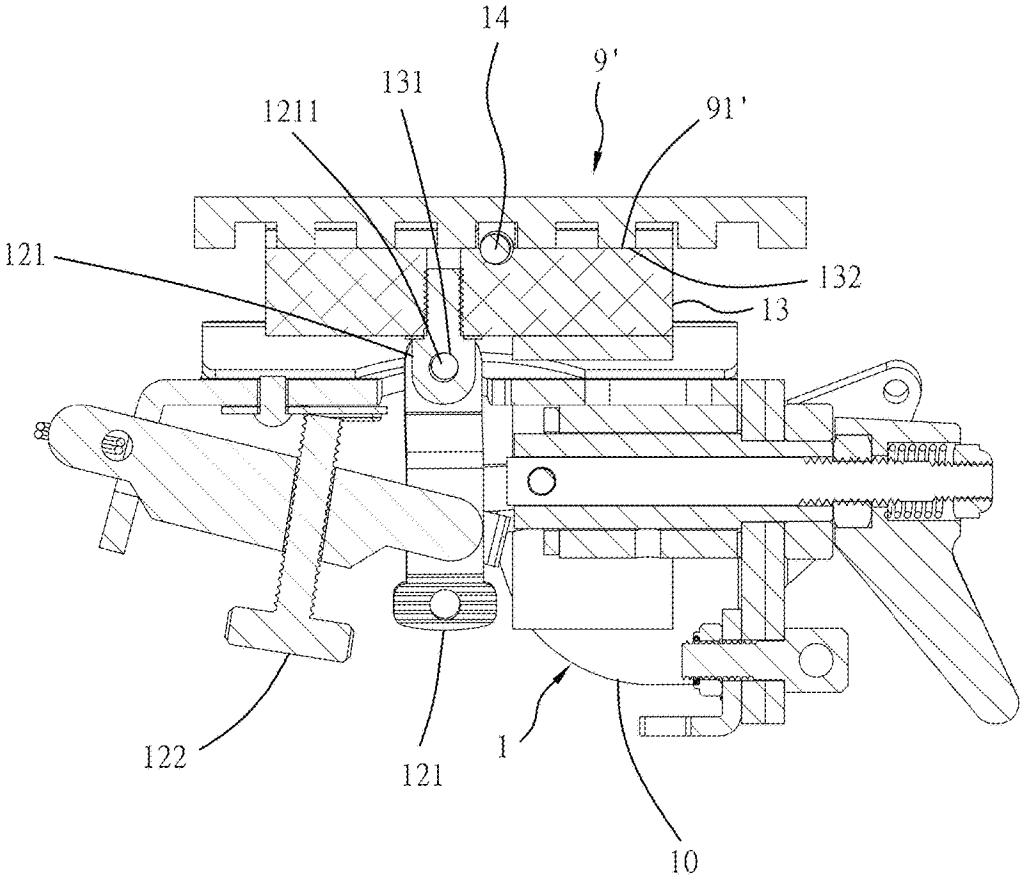
FIG. 13 is a schematic applied view of the alternate form of the bipod shown in FIG. 11.
Figure 14:
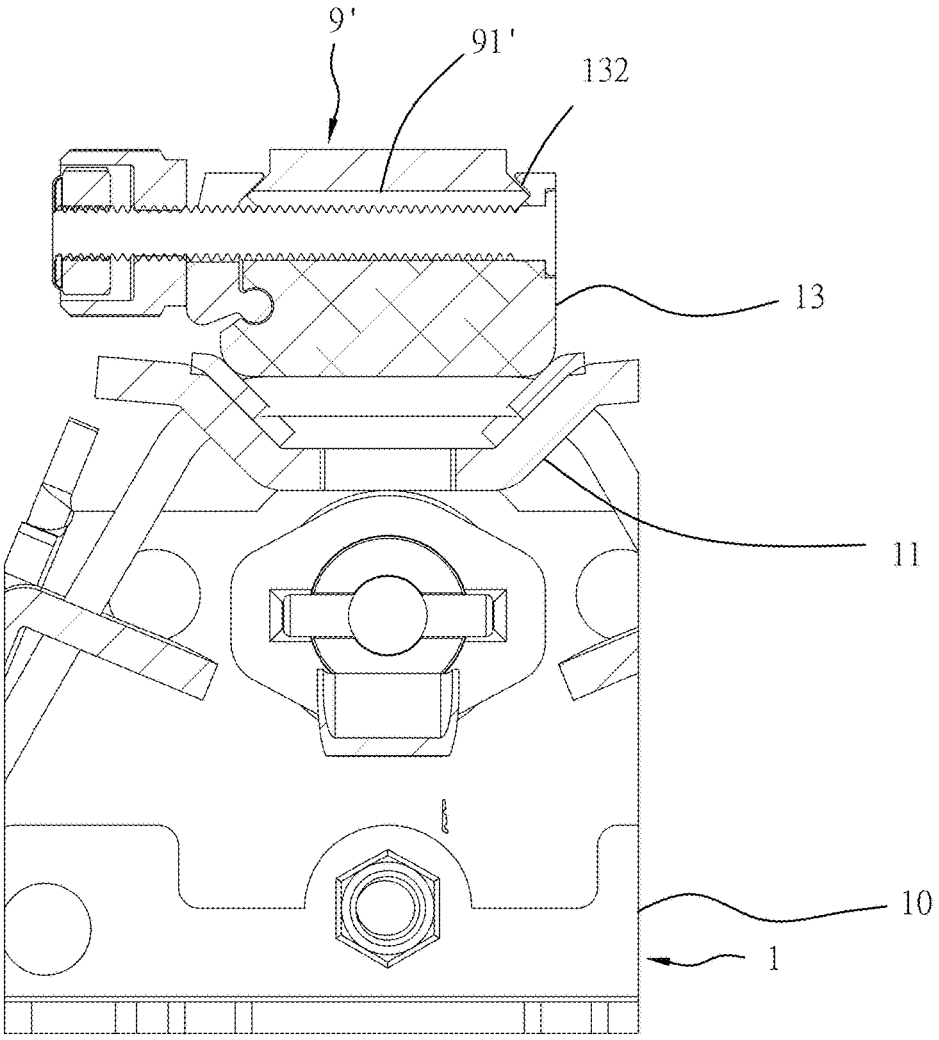
FIG. 14 is an enlarged view of FIG. 13 when viewed from another angle.

In an alternate form of the present invention, the bipod is configured for use with a gun 9' having a slide block 91'. As illustrated in FIGS. 11-13, the support frame unit 1 in accordance with this alternate form comprises a holder block 13 and a second lock screw 14. The second lock screw 14 is transversely threaded into the holder block 13. The holder block 13 comprises a transverse through hole 131 disposed at a bottom side thereof. After engagement of the two clamping pins 1211 of the grip clip 121 into the transverse through hole 131 of the holder block 13 (see FIGS. 12 and 13), the first lock screw 122 is fastened tight to lock the holder block 13 and the support fitting 11 of the support frame unit 1 together. The holder block 13 further comprises a sliding groove 132 defined in a top side thereof for receiving the slide block 91' of the gun 9'. After insertion of the slide block 91' of the gun 9' into the sliding groove 132 of the holder block 13, the second lock screw 14 is fastened tight to lock the holder block 13 to the slide block 91' of the gun 9'.

Figure 15:
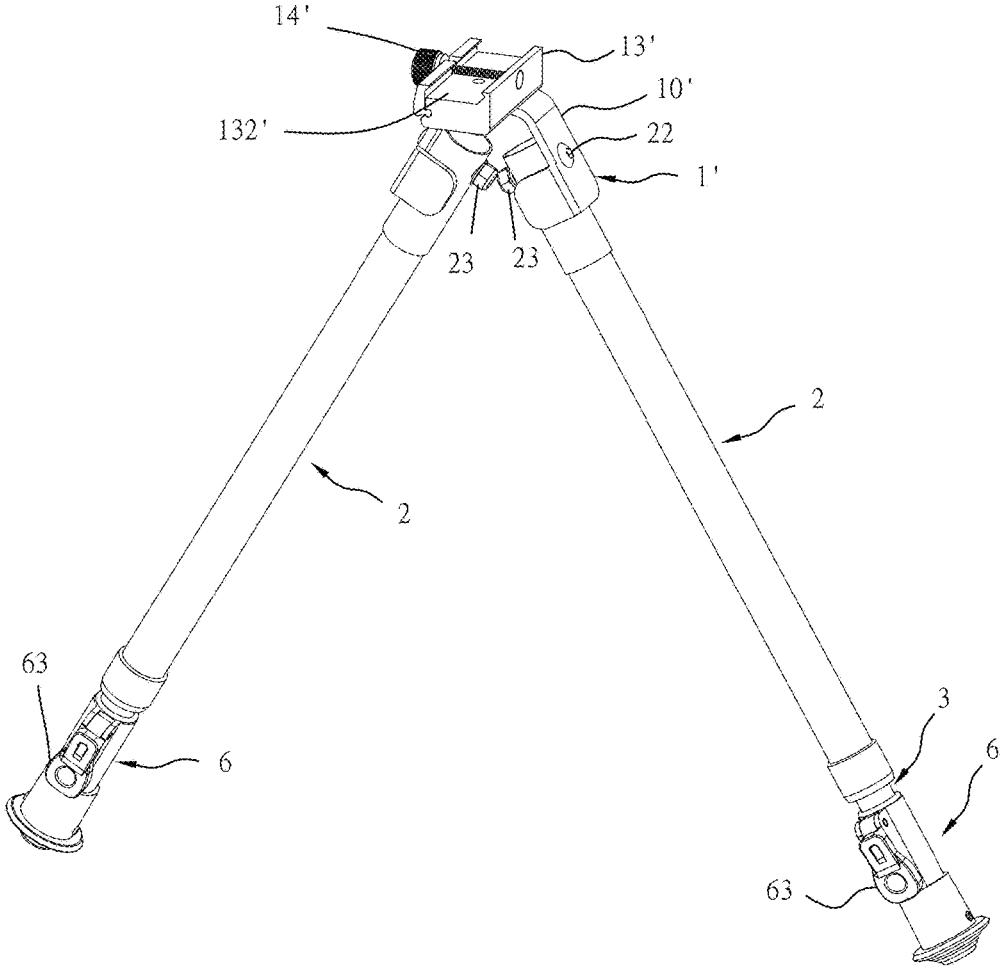
FIG. 15 illustrates another alternate form of the bipod in accordance with the present invention.
Figure 16:
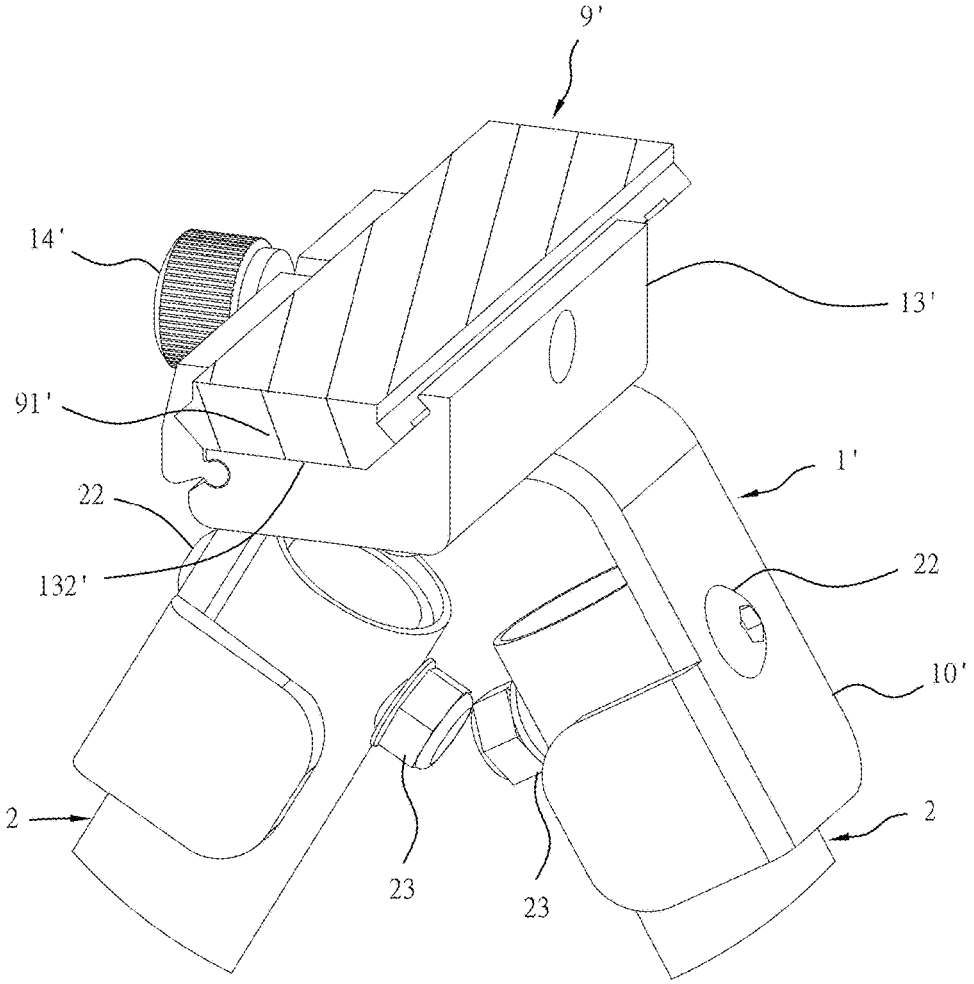
FIG. 16 is an applied view, in an enlarged scale, of a part of the bipod shown in FIG. 15.
Figure 17:
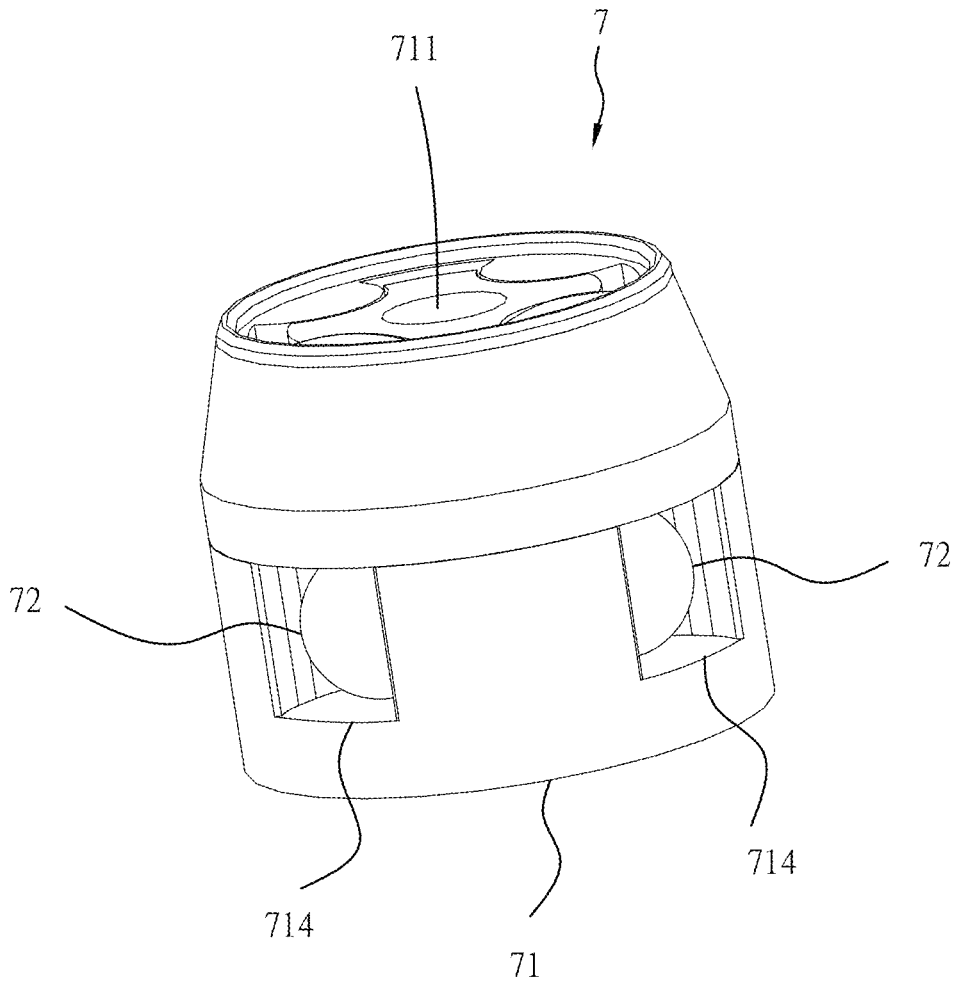
FIG. 17 is an enlarged view of left and right ball bearings shown in FIG. 3.

FIG. 15 illustrates another alternate form of the present invention. In this alternate form, the support frame unit 1' comprises a bracket 10' and a holder block 13'. The holder block 13' is arranged on the top side of the bracket 10' and mounted with a third lock screw 14', defining a sliding groove 132' in a top side thereof for receiving a slide block 91' of a gun 9' (see FIG. 16). In installation, a third lock screw 14' is used and fastened tight to lock the holder block 13' to the slide block 91' of the gun 9'. Further, the support frame unit 1' is pivotally connected to the left and right outer tubes 2 by a first pivot bolt and nut set 22,23. In this alternate form, the left and right inner tubes 3, the left and right guide blocks (not shown), the left and right link (not shown), the left and right pressure handle holders 6 and the left and right ball bearings (not shown) are same as like component parts in the embodiments shown in FIGS. 1-14.

In conclusion, the bipod of the present invention has the advantages and effects as follows:

1. It allows fixation of a gun 9,9' for easy carrying with the attached gun to enhance application flexibility and mobility.

2. The user can use one hand to bias the left/right pressure handle 63 with the left/right inner tube 3 through 360-degrees to any desired angle and then downwardly adjust the elevation of the left/right inner tube 3 relative to the left/right outer tube 2, or press the left/right pressure handle 63 with one hand to upwardly adjust the elevation of the left/right inner tubes 3 relative to the left/right outer tubes 2 in a stepless manner; when released the hand from the left/right pressure handle 63, the left/right link 5 is pushed to move the left/right ball bearing 7, forcing the respective inner sides 721 of the balls 72 into engagement with the top cone 41 of the left/right guide block 4 and the respective outer sides 722 of the balls 72 into engagement with the inside wall 21 of the left/right outer tube 2 to lock the left/right inner tube 3 to the left/right outer tube 2.

What is claimed is:

1. A bipod, comprising:

a support frame unit comprising a bracket, a support fitting mounted at a top side of said bracket, and a mounting assembly adapted for securing a gun to said support fitting, said bracket comprising opposing left and right pivot holes and opposing left and right locating holes;

left and right outer tubes having respective top ends thereof respectively pivotally connected to said left and right pivot holes of said bracket of said support frame unit by a respective first pivot bolt and nut set and respective bottom ends thereof respectively mounted with a respective end cap;

left and right inner tubes respectively and axially slidably mounted in said left and right outer tubes and respectively rotatable through 360-degrees angle relative to said left and right outer tubes;

left and right guide blocks respectively affixed to respective top ends of said left and right inner tubes, said left and right guide blocks each comprising a top cone gradually reducing in diameter from a bottom side toward an opposing top side thereof and an axial through hole axially cut through said opposing top and bottom sides thereof;

left and right links respectively inserted into said left and right inner tubes;

left and right stop rings respectively fastened to said left and right links above a middle part thereof;

left and right compression springs respectively mounted around said left and right links within said left and right inner tubes and respectively stopped between said left and right stop rings and said left and right guide blocks;

left and right pressure handle holders respectively affixed to respective bottom ends of said left and right inner tubes by a respective first fastener and respectively defining therein a longitudinal through hole for the insertion of respective bottom ends of said left and right links respectively;

left and right pressure handles respectively pivotally connected to said left and right pressure handle holders by a respective second pivot member, said left and right pressure handles each comprising a guide surface respectively abutted against respective bottom ends of said left and right links for lifting said left and right links when said left and right pressure handles are respectively biased by an external force toward said left and right inner tubes and for allowing said left and right links to be respectively forced downwards by said left and right compression springs after the said external force is released from said left and right pressure handles;

left and right foot members respectively affixed to respective bottom sides of said left and right pressure handle holders by a respective second fastener;

left and right ball bearings respectively fastened to respective opposing top ends of said left and right links by respective positioning component sets for vertical movement with said left and right links, said left and right ball bearings each comprising a bearing block, which comprises a top axle hole of relatively smaller diameter, an opposing bottom axle hole of relatively larger diameter and an intermediate hole axially connected between said top axle hole and said bottom axle hole and a plurality of balls rotatably and radially movably mounted in said bearing block such that when said left and right ball bearings are moved upwards with said left and right links, respective inner sides of said balls are respectively disengaged from said top cones of said left and right guide blocks for allowing said left and right inner tubes to slide vertically relative to said left and right outer tubes; when said left and right ball bearings are moved downwards with said left and right links, said respective inner sides of said balls are respectively abutted against said top cones of said left and right guide blocks and respective outer sides of said balls are respectively abutted against respective inside walls of said left and right outer tubes; and left and right torsion springs with respective one ends thereof respectively fastened to said left and right locating holes of said bracket of said support frame unit and respective opposite ends thereof respectively fastened to the said top ends of said left and right outer tubes.

2. The bipod as claimed in claim 1, wherein each said bearing block of said left and right ball bearings comprises a plurality of transverse through holes equiangularly spaced around the periphery thereof and respectively disposed in communication with the said intermediate hole of the respective said bearing block for the passing of the respective said outer sides of the respective said balls into engagement with the respective said inside walls of said left and right outer tubes.

3. The bipod as claimed in claim 1, wherein said support fitting of said support frame unit comprises a locating hole; said mounting assembly comprises a grip clip insertable into the said locating hole of said support fitting and a first lock screw for locking said support fitting to the gun being mounted in said mounting assembly, said grip clip comprising two clamping pins facing toward each other for engaging into a gun strap hole at a swivel stud of the attached said gun.

4. The bipod as claimed in claim 3, wherein said support frame unit further comprises a holder block and a second lock screw threaded into said holder block, said holder block comprising a transverse through hole disposed in a bottom side thereof for receiving said clamping pins of said grip clip for allowing said holder block to be locked to said support fitting by said first lock screw and a sliding groove defined in a top side thereof for receiving a slide block of said gun for allowing said holder block to be locked to said slide block of said gun by said second lock screw.

5. The bipod as claimed in claim 1, wherein said support frame unit further comprises a holder block adapted for mounting at a top side of said bracket and defining a sliding groove in a top side thereof for receiving a slide block of said gun, and a third lock screw threaded into said holder block and adapted for locking said holder block to said slide block of said gun.

6. A bipod, comprising:

a support frame unit comprising a bracket, a support fitting mounted at a top side of said bracket, and a mounting assembly adapted for securing a gun to said support fitting, said bracket comprising opposing left and right pivot holes and opposing left and right locating holes;

left and right outer tubes having respective top ends thereof respectively pivotally connected to said left and right pivot holes of said bracket of said support frame unit by a respective first pivot bolt and nut set and respective bottom ends thereof respectively mounted with a respective end cap;

left and right inner tubes respectively and axially slidably mounted in said left and right outer tubes;

left and right guide blocks respectively affixed to respective top ends of said left and right inner tubes, said left and right guide blocks each comprising a top cone gradually reducing in diameter from a bottom side toward an opposing top side thereof and an axial through hole axially cut through said opposing top and bottom sides thereof;

left and right links respectively inserted into said left and right inner tubes;

left and right stop rings respectively fastened to said left and right links above a middle part thereof;

left and right compression springs respectively mounted around said left and right links within said left and right inner tubes and respectively stopped between said left and right stop rings and said left and right guide blocks;

left and right pressure handle holders respectively affixed to respective bottom ends of said left and right inner tubes by a respective first fastener and respectively defining therein a longitudinal through hole for the insertion of respective bottom ends of said left and right links respectively;

left and right pressure handles respectively pivotally connected to said left and right pressure handle holders by a respective second pivot member, said left and right pressure handles each comprising a guide surface respectively abutted against respective bottom ends of said left and right links for lifting said left and right links when said left and right pressure handles are respectively biased by an external force toward said left and right inner tubes and for allowing said left and right links to be respectively forced downwards by said left and right compression springs after the said external force is released from said left and right pressure handles;

left and right foot members respectively affixed to respective bottom sides of said left and right pressure handle holders by a respective second fastener;

left and right ball bearings respectively fastened to respective opposing top ends of said left and right links by respective positioning component sets for vertical movement with said left and right links, said left and right ball bearings each comprising a bearing block, which comprises a top axle hole of relatively smaller diameter, an opposing bottom axle hole of relatively larger diameter and an intermediate hole axially connected between said top axle hole and said bottom axle hole and a plurality of balls rotatably and radially movably mounted in said bearing block such that when said left and right ball bearings are moved upwards with said left and right links, respective inner sides of said balls are respectively disengaged from said top cones of said left and right guide blocks for allowing said left and right inner tubes to slide vertically relative to said left and right outer tubes; when said left and right ball bearings are moved downwards with said left and right links, said respective inner sides of said balls are respectively abutted against said top cones of said left and right guide blocks and respective outer sides of said balls are respectively abutted against respective inside walls of said left and right outer tubes; and left and right torsion springs with respective one ends thereof respectively fastened to said left and right locating holes of said bracket of said support frame unit and respective opposite ends thereof respectively fastened to the said top ends of said left and right outer tubes.

7. The bipod as claimed in claim 6, wherein each said bearing block of said left and right ball bearings comprises a plurality of transverse through holes equiangularly spaced around the periphery thereof and respectively disposed in communication with the said intermediate hole of the respective said bearing block for the passing of the respective said outer sides of the respective said balls into engagement with the respective said inside walls of said left and right outer tubes.

8. The bipod as claimed in claim 6, wherein said support fitting of said support frame unit comprises a locating hole; said mounting assembly comprises a grip clip insertable into the said locating hole of said support fitting and a first lock screw for locking said support fitting to the gun being mounted in said mounting assembly, said grip clip comprising two clamping pins facing toward each other for engaging into a gun strap hole at a swivel stud of the attached said gun.

9. The bipod as claimed in claim 8, wherein said support frame unit further comprises a holder block and a second lock screw threaded into said holder block, said holder block comprising a transverse through hole disposed in a bottom side thereof for receiving said clamping pins of said grip clip for allowing said holder block to be locked to said support fitting by said first lock screw and a sliding groove defined in a top side thereof for receiving a slide block of said gun for allowing said holder block to be locked to said slide block of said gun by said second lock screw.

10. The bipod as claimed in claim 6, wherein said support frame unit further comprises a holder block adapted for mounting at a top side of said bracket and defining a sliding groove in a top side thereof for receiving a slide block of said gun, and a third lock screw threaded into said holder block and adapted for locking said holder block to said slide block of said gun.

* * * * *